United States Patent [19]

Klawieter et al.

[11] Patent Number: 4,739,912

[45] Date of Patent: Apr. 26, 1988

[54] CLOTHING HANGER

[75] Inventors: Robert A. Klawieter, Grand Rapids; Robert A. Bredeweg, Zeeland, both of Mich.

[73] Assignee: Batts, Inc., Zeeland, Mich.

[21] Appl. No.: 898,368

[22] Filed: Aug. 20, 1986

Related U.S. Application Data

[63] Continuation-in-part of Ser. No. 715,666, Mar. 25, 1985, abandoned.

[51] Int. Cl.[4] ..... A47G 25/32; A47G 25/38

[52] U.S. Cl. ..... 223/85; 223/92; 223/DIG. 4; 211/115; 24/453; 24/704; 29/453

[58] Field of Search ..... 223/85, 88, 92, DIG. 4; 211/115; 29/453; 24/453, 704

[56] References Cited

U.S. PATENT DOCUMENTS

| | | | |
|---|---|---|---|
| 1,266,358 | 5/1918 | Videgaray | 223/88 |
| 2,367,657 | 1/1945 | Boersma . | |
| 3,227,334 | 1/1966 | Samuelsson . | |
| 3,235,297 | 2/1966 | Fernberg | 24/453 X |
| 3,411,679 | 11/1968 | Rôoz | 223/88 X |
| 3,524,241 | 8/1970 | Walkup et al. . | |
| 3,631,584 | 1/1972 | Walkup et al. . | |
| 3,963,154 | 6/1976 | Schwartz et al. . | |
| 4,233,715 | 11/1980 | McDermott | 24/704 |
| 4,410,295 | 10/1983 | Ersoy et al. . | |
| 4,615,447 | 10/1986 | Walter | 223/92 X |

FOREIGN PATENT DOCUMENTS

| | | | |
|---|---|---|---|
| 1176422 | 11/1958 | France | 24/704 |
| 1495817 | 8/1967 | France . | |
| 2345126 | 10/1977 | France . | |
| 179009 | 4/1962 | Sweden . | |
| 256380 | 8/1926 | United Kingdom . | |
| 1582576 | 1/1981 | United Kingdom . | |

*Primary Examiner*—Robert R. Mackey

*Attorney, Agent, or Firm*—Price, Heneveld, Cooper, DeWitt & Litton

[57] ABSTRACT

A hanger is made with a molded plastic body and a metal hook. The body has a vertical hole to receive the shank of the hook. The lower end of the hole communicates with an opening or pocket in the hanger body. The shank of the hook is provided with a diametrically enlarged head, the end of which is tapered. The cylindrical diameter of the shank is less than that of the hole and the diameter of the head is more than that of the hole. The hook is assembled by forcing or plunging the head and shank through the hole until the head seats in the opening. The resilience of the plastic of the hanger body restores the hole to its original diameter and a substantially radial shoulder formed by the top of the head seats against the top of the opening about the end of the hole supporting the body on and for free rotation about the hook. The substantially radial shoulder is canted at an oblique angle with respect to the radial direction and an annular area of reduced cross section is disposed between the shoulder and the cylindrical diameter of the shank.

2 Claims, 2 Drawing Sheets

CLOTHING HANGER

This is a continuation-in-part application of prior application Ser. No. 715,666 filed Mar. 25, 1985, now abandoned.

BACKGROUND OF THE INVENTION

This invention relates to clothing hangers and, in particular, to clothing hangers with metal hooks and molded plastic bodies.

Plastic hangers with metal hooks are desirable for a number of reasons. The hooks can be made to be rotatable with respect to the plastic hanger body, so that the clothes can be displayed from front or side and the sales clerk can rotate the garment to display both front and back. The metal hooks are strong and capable of substantial abuse without breakage. Thus, the plastic hanger with a metal hook combines strength of metal where it is needed into the hook with lightweight, inexpensive plastic to provide the garment shaping body of the hanger body.

The metal hook is typically attached to the plastic hanger body by providing a vertical hole in the plastic body extending downwardly into the body. A transverse opening is provided through the body and intersecting the vertical hole such that the bottom end of the shank portion of the metal hook will extend into the opening after having been slidably inserted in the hole. The free end of the shank is then crimped by placing the hook and hanger body in a stamping press. The two dies come together and meet in the transverse opening to crimp the shank adjacent the end, forming a pair of diametrically positioned wings to prevent the hook from being withdrawn.

This arrangement requires several steps to complete insertion of hook in the hole, including accurately locating the assembled hook and hanger in the crimping equipment, actuating the equipment to form the crimp and removal of the finished assembly. The initial assembly of the hook and hanger body normally also requires the equipment to position the curved portion of the hook in the plane of the hanger body and to accurately locate the hook axially of the hole to be certain that the crimp is formed at the correct place in the shank. Even with the best high speed automated equipment, this is a time consuming, labor intensive operation. It also requires expensive precision equipment to be certain that each hanger and hook are accurately assembled and positioned when the crimping equipment is actuated. Failure to do so will result either in a faulty product or destruction of the hanger body because the dies will hit and crush the plastic body portion instead of passing through the transverse opening through the body and crimping the metal shank. Because of the number of steps involved and the nature of the product, the operating capacity of the best of automated assembly equipment for this product is quite limited. Thus, it is a significant cost factor in the manufacture of this type of hanger.

SUMMARY OF THE INVENTION

The hanger of the present invention has a body made of molded plastic and a metal supporting hook. The supporting hook has a body engaging straight cylindrical shank portion. The free end of the shank portion has a head which is tapered with progressively decreasing lateral dimensions away from the hook. The head also has a substantially radial shoulder facing the shank. An opening is located in the hanger body which is shorter than the shank and smaller in cross section than the shoulder. The head and shank are press fitted or plunged through the opening, the plastic of the body being sufficiently resilient to allow the head to pass and having sufficient memory to return the opening to its original shape after the head has passed therethrough. Thus, the hook may be rotated with respect to the body, and the body is supported on the shoulder. The substantially radial shoulder is canted at an oblique angle with respect to the radial direction, the least diameter of the canted shoulder facing the hook. An annular area of reduced cross section is provided between the canted shoulder and the cylindrical shank portion. The canted shoulder substantially reduces cutting of the molded plastic body when the hanger is subjected to high loads and eccentric loads. Pullout is still further reduced by the annular area of reduced cross section which fills in with plastic under high loads to provide an even larger load supporting area to engage the canted shoulder. The plunge assembly motion of the metal hook and plastic body greatly facilitate the automated assembly of the hanger of the present invention. This motion is so simple that it can be totally automated with a relatively unsophisticated machine which substantially decreases the cost of the hanger. This is a significant advantage in the hanger business which is very competitive and price sensitive.

DETAILED DESCRIPTION OF THE PREFERRED EMBODIMENT

Figure 1:
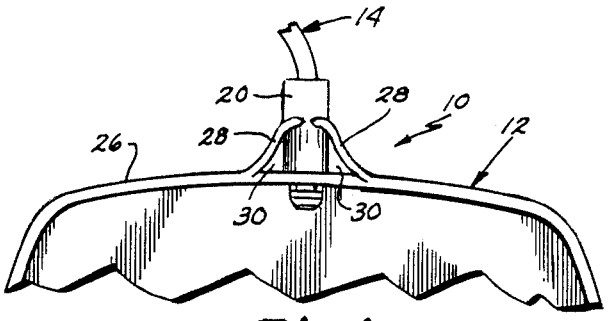
FIG. 1 is a fragmentary front elevation of a hanger incorporating the present invention.

Referring to the figures, the hanger 10 of the present invention includes a molded plastic hanger body 12 which can be of any desired shape or configuration and a supporting hook 14 fabricated of metal. Supporting hook 12 has a support engaging portion or hook (shown in FIG. 6) and a straight shank portion 16 which is slidably inserted into the opening 18 in the hanger body. In the particular construction illustrated, this includes a tubular member 20 extending upwardly from the top of the hanger. However, it is to be understood that the tubular member could be formed within the hanger body as is illustrated by the tubular body 20*a* in FIG. 6. A head 22 is disposed at the end of shank portion 16 and has progressively decreasing lateral dimensions tapering away from the curved hook portion of supporting hook 14. Head 22 also has a substantially radial shoulder 24 facing upwardly toward the shank portion 16. The shoulder provides a substantially flat smooth annular bearing surface for engagement with the hanger body. Opening 18 is molded into the hanger body and is shorter than the length of shank 16 and of smaller diameter than shoulder 24 but of greater diameter than the shank. The hanger is assembled by forcing or plunging the head 22 through opening 18. The plastic of the hanger body 12 is of sufficient resiliency to allow head 22 to pass through opening 18 and has sufficient memory to return opening 18 to its original cross section after the head has passed through. Thus, hanger body 12 will be supported on shoulder 24, and hook 14 can be rotated with respect to the body by rotating shank 16 within tubular member 20.

The hanger body 12 can have a variety of different configurations, including for example, the conventional triangular type molded plastic hanger, a hanger with oppositely extending arms for shirts and blouses, or a pants hanger with parallel clamping bars. The supporting hook arrangement of the present invention can be used with any of these types of hangers.

The illustrated hanger body 12 has a peripheral flange 26 extending along its upper edge above which tubular member 20 extends. Tubular member 20 is braced against lateral movement by two buttressing webs 28 which extend upwardly from flange 26 and connect with tubular member 20. Gussets 30 reinforce buttressing webs 28 and connect webs 28 to tubular member 20.

Figure 2:
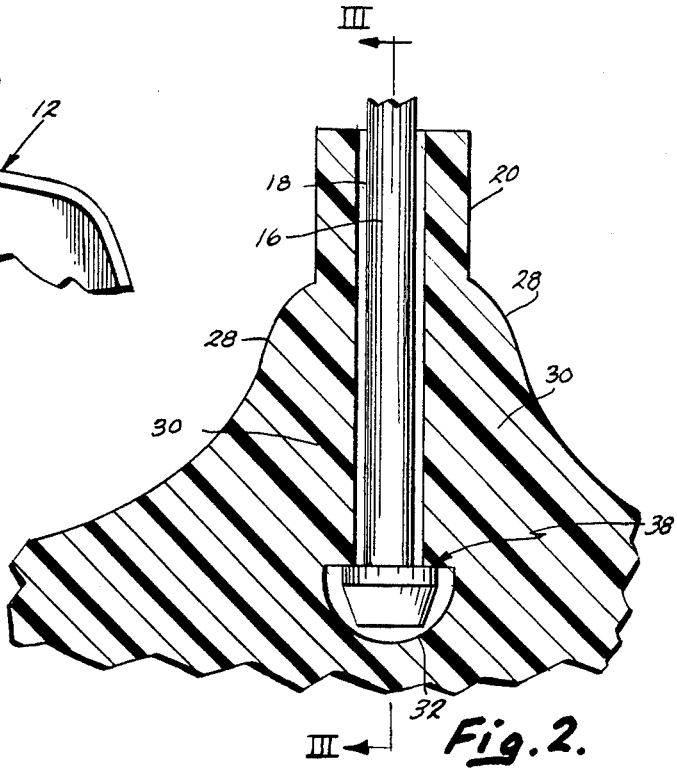
FIG. 2 is an enlarged, fragmentary sectional view taken along the plane of line II—II of FIG. 3.
Figure 3:
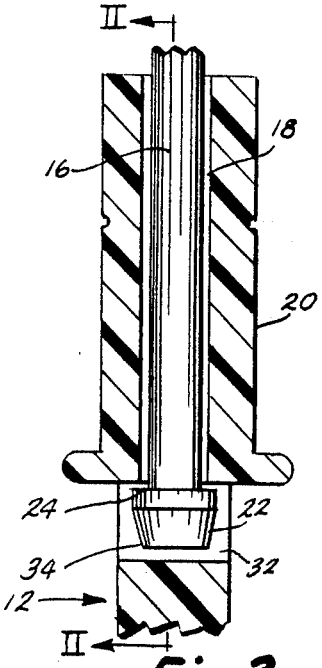
FIG. 3 is a fragmentary sectional view taken along the plane of line III—III of FIG. 2.

Tubular member 20 extends upwardly from web 26 and has a vertical, central opening 18 of uniform diameter. The lower end of opening 18 communicates with a recess 32. The recess accommodates the head 22 after it has been inserted through opening 18. In a preferred construction, the recess 32 extends entirely through hanger body 12 below flange 26, as shown in FIGS. 2 and 3.

The shank portion 16 of supporting hook 14 is straight and of constant diameter throughout its length except for head 22. Head 22 includes a shoulder 24 facing shank 16, which has a diameter larger than the diameters of shank 16 and opening 18. Head 22 also includes a frustoconical portion 34 which tapers in diameter from the diameter of shoulder 24 to a diameter at the free end of the shank narrower than the diameter of opening 18.

To assemble the hanger, the narrow diameter end of head 22 is introduced into the top of opening 18 and pushed through opening 18 until its exits into recess 32. Because the hanger body is made of a material which is sufficiently resilient to allow the head to pass through opening 18 and also has sufficient memory to return opening 18 to its original diameter and tubular member 20 to its original shape, head 22 will be captured within recess 32 because shoulder 24 will prevent head 22 from being withdrawn back through opening 18. Thus, the hanger will be supported from shoulder 24 as shown in FIG. 2 with the top of shoulder 24 engaging the bottom of flange 38.

Figure 7:
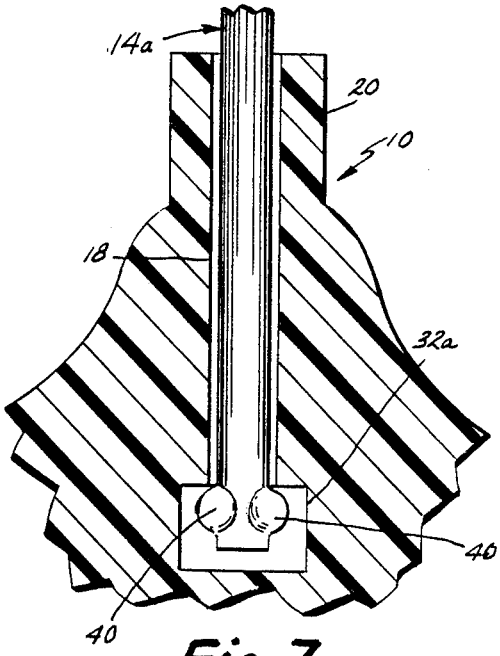
Fig. 7. PRIOR ART
FIG. 7 is a fragmentary sectional view similar to FIG. 2 illustrating the prior art method of securing the hook.

The prior art construction for securing a swivel hook to a molded plastic hanger is illustrated in FIG. 7. In this construction, the shank of the hook **14*a* while of uniform diameter is inserted in the hole 18 until its free end is seated in the opening 32*a*. The assembled hanger and hook is then placed in a stamping press where the end of the shank is crimped between two dies to form the wings or ears 40. The problem with this, as indicated above, is that the hanger must be accurately positioned with respect to the dies so that the shank is centered between the dies and the dies close within the opening 32*a*. If the hanger and dies are misaligned, the dies may strike the hanger body and reduce it to scrap. To avoid excessive scrap rates, the opening 32*a* is normally substantially larger than the required for this invention. Even the larger opening does not entirely solve the alignment problem because misalignment with the shank will result in the wings or ears 40 being misshapen and distorted. The distortion may be sufficient to necessitate scrapping the hanger and even if it is not sufficient to render the hanger useless, it is likely to require the hanger to be sold as a damaged or defective product. Because this invention permits a much smaller opening 32** to be used, it is less conspicuous and this contributes to the aesthetics of the hanger. With the hanger assembly of the present invention, crimping is unnecessary so this source of defective product is eliminated.

Another advantage of the invention is that the shoulder 24 provides a broad, flat bearing surface of substantial area to support the weight of the hanger body and of the garment hung on it. This reduces the unit loading in the area of contact between the hook and hanger body. This contrasts with the narrow top bearing surfaces of the ears 40 which had a tendency to gradually cut into the body of the hanger, especially if the hanger was used for heavy clothing.

Figure 4:
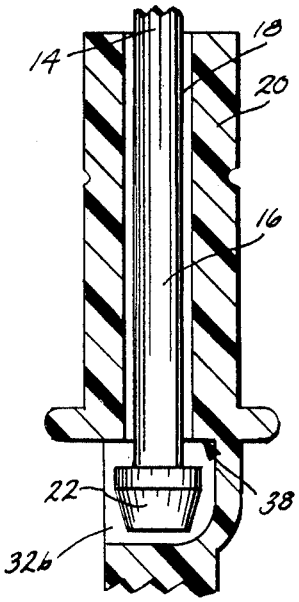
FIG. 4 is a sectional view similar to FIG. 3 illustrating a modified construction for the hanger.

The hanger assembly of the present invention can be modified. As shown in FIG. 4, for instance, head 22 can be received within a recess **32*b*** which opens through only one face of the hanger body.

Figure 5:
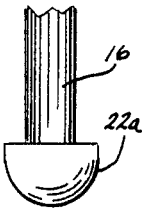
FIG. 5 is a fragmentary view of a modified head for the hook shank of the present invention.

Similarly, a modified design for the head can be used such as making it generally hemispherical in shape as illustrated in FIG. 5. The diameter of hemispherical head **22*a* is the same as the diameter of shoulder 24 of head 22. The hemispherical head 22*a*, like the frustoconical head 22**, tapers to an end of lesser cross section or lateral dimension and thus provides the wedging action to facilitate assembly.

Figure 6:
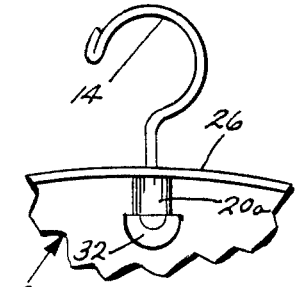
FIG. 6 is a fragmentary elevation view of a modified construction for this invention.

FIG. 6 illustrates the fact that the use of the tubular member 20 above the flange 26 and the buttressing webs 28 are not necessary to the practice of this invention. The tubular member **20*a* can be recessed into the hanger body 12*a* below the flange 26 without in any way changing the principles of the invention. Irrespective of the construction utilized, the surface 38 of the hanger body surrounding the end of the opening 18 in the recess 32** should be smooth and perpendicular to the axis of the opening. This will facilitate rotation of the hook in the opening and increase the actual bearing surface provided between hook and hanger body.

Regardless of what head configuration is used, the material out of which hanger body 12 of the present invention is made must be sufficiently resilient to allow the head to pass through opening 18 and cause the material around the opening to return to its original cross-sectional shape. Polypropylene has been found to be such a material. Other such materials will be apparent to those of ordinary skill in the art.

The polypropylene material which is preferred, has a density of approximately 0.9 to 1.05 grams/cubic centimeter; a tensile yield strength of 4000 to 5500 psi; a modulous of elasticity of 200,000 to 225,000 psi; and a flexural modulus of approximately 225,000 psi. While polypropylene is preferred, other polymers or blends of polymers featuring these physical characteristics may be suitable for the application.

Figure 8:
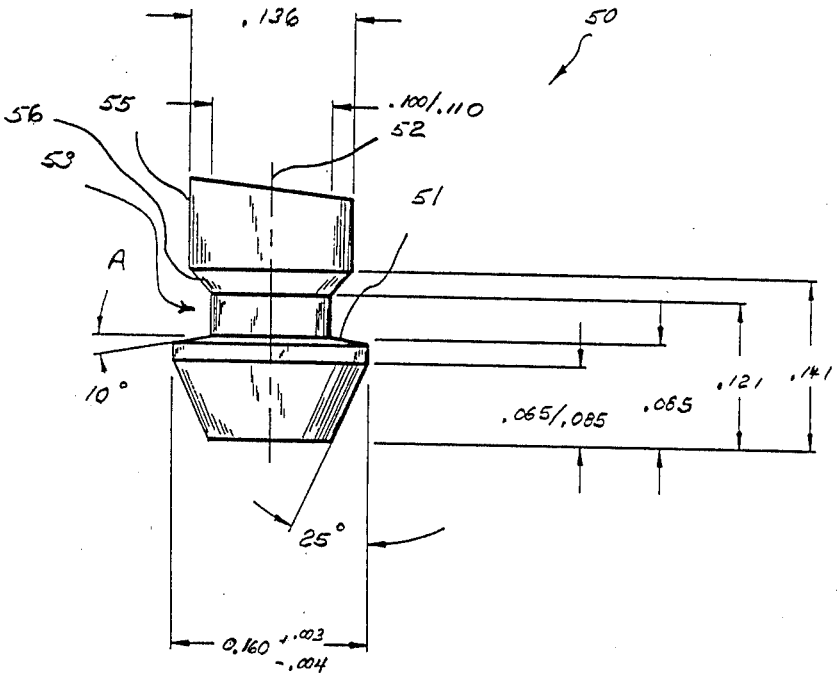
FIG. 8 is a fragmentary view of another embodiment of the head of the hook shank of the present invention.

With reference now to FIG. 8, another modification of the design for the head is generally illustrated at 50. In this case, it has been found desirable to provide the radially extending shoulder 51 with a canted surface. More particularly, it has been found to be desirable to cant the shoulder 51 at an oblique angle A, which is approximately 10 degrees relative to the radial direction. Stated otherwise, the surface of shoulder 51 is angled approximately 80 degrees from the central axis 52, or axial direction, of the cylindrical portion of the shank. The canting of the radial shoulder in this fashion has been found to substantially reduce cutting of the molding plastic body when the hanger is subjected to high loads and eccentric loads. Still further, in this improved version of the head, the ultimate load capacity of the hanger is increased and the tendency for pull-out is still further reduced by providing an annular area 53 of substantially reduced cross section disposed between the radial shoulder 51 and the cylindrical surface 55 of the shank. Preferably, the area of reduced cross section 53 is provided with a circular axial cross section and interposed between it and the cylindrical portion 55 of the shank is a second frustoconical surface 56. The provision of the area of reduced cross section improves the performance of the hanger by providing an area within which the plastic material of the hanger body fills under high loads and plastic deformation to provide an even larger load supporting area to engage the radial shoulder 51. Thus, once the improved structure starts to yield and the plastic material begins to flow, the load bearing capacity of the hanger is actually increased. Actual dimensions in inches of the production part used in a hanger molded from polypropylene having the desirable material characteristics outlined above are indicated directly on the drawing. The shank and head are preferably formed from a thread rolled steel wire blank.

Other modifications of the invention will be apparent to those of ordinary skill in the art. Such modifications are to be considered within the scope of the present invention unless the claims which follow expressly state otherwise.

We claim:

1. An article hanger having a body of molded plastic and a supporting hook, said hook being fabricated of metallic wire and having a support engaging portion and a body engaging straight shank portion, said straight shank portion comprising a smooth cylindrical surface extending in an axial direction; the free end of said shank portion having a circular head, said head having a flat tapered portion with its least diameter directed away from said support engaging portion, said head having a circular portion of uniform diameter, said circular portion terminating in a smooth surfaced annular bearing shoulder, extending in a substantially radial direction, surrounding said shank and facing toward said support engaging portion; said bearing shoulder of said head extending in a direction canted with respect to the radial direction, said bearing shoulder being canted away from said support engaging portion at a minor oblique angle with respect to the radial direction, the least diameter of said canted shoulder being directed toward said support engaging portion; an axially extending substantially continuous opening in said body through which said head is pressed, said shank axially and slidably engaging said opening, said opening being shorter in length than said straight shank portion, larger in diameter than said cylindrical surface of said shank and smaller in cross section than said shoulder; a chamber at the lower end of said opening of a size just sufficient to receive said head, the combined lengths of said opening and chamber extending vertically into the body only a minor portion of the height of the body, said opening having a flat bearing surface extending in the radial direction surrounding the lower end of said opening; the plastic of said body being provided with a modulous of elasticity and sufficient lubricity to permit said head to be axially forcibly passed through said opening a distance just sufficient to lodge said head in said chamber, and said body having sufficient memory to substantially return said opening to its original cross-sectional dimension after said head has passed therethrough to provide a permanent substantially fail-safe and freely rotatable one-way snap-lock coupling between said hook and said molded plastic body through engagement of said bearing shoulder and said bearing surface; said shank having an annular channel formed therein, one wall of which is formed by said head bearing shoulder and providing an annular recess having an inner diameter less than that of said shank for receiving the plastic of the hanger body which has been caused to migrate radially thereinto by pressure exerted against the plastic by the bearing shoulder of said head and thereby form a plastic bearing surface of substantially the same area as that of said bearing shoulder.

2. The article hanger of claim 1 wherein said plastic body is formed from a polymeric material consisting substantially of polypropylene having a tensile strength of approximately 5,000 psi and a modulus of elasticity of approximately 200,000 psi.

* * * * *

UNITED STATES PATENT AND TRADEMARK OFFICE

CERTIFICATE OF CORRECTION

PATENT NO. : 4,739,912

DATED : April 26, 1988

INVENTOR(S) : Robert A. Klawieter & Robert A. Bredeweg

It is certified that error appears in the above-identified patent and that said Letters Patent is hereby corrected as shown below:

Column 2, line 56:
"hook 12" should be --hook 14--.

Column 3, line 29:
"web" should be --flange--.

Column 4, line 5:
"the" should be --that--.

Signed and Sealed this

Sixth Day of December, 1988

*Attest:*

DONALD J. QUIGG

*Attesting Officer*

*Commissioner of Patents and Trademarks*